US006520290B1

(12) United States Patent
Carter

(10) Patent No.: US 6,520,290 B1
(45) Date of Patent: Feb. 18, 2003

(54) FALL PROTECTION METHOD AND APPARATUS

(76) Inventor: Charles L. Carter, 4818 Jade St. NE., Salem, OR (US) 97305

( * ) Notice: Subject to any disclaimer, the term of this patent is extended or adjusted under 35 U.S.C. 154(b) by 0 days.

(21) Appl. No.: 09/550,927

(22) Filed: Apr. 17, 2000

(51) Int. Cl.[7] ..... A62B 35/00
(52) U.S. Cl. ..... 182/36; 182/3
(58) Field of Search ..... 182/3, 4, 36, 56.02; 482/43

(56) References Cited

U.S. PATENT DOCUMENTS

| | | | | | |
|---|---|---|---|---|---|
| 44,134 | A | * | 9/1864 | Worsley | |
| 2,317,346 | A | | 4/1943 | Reith | |
| 2,496,748 | A | * | 7/1950 | Pond | |
| 2,725,853 | A | | 12/1955 | Nordheim | |
| 3,004,519 | A | | 10/1961 | Weissman | |
| 3,006,645 | A | | 10/1961 | Frazier | |
| 3,721,216 | A | * | 3/1973 | Lippe et al. | 119/792 |
| 4,848,516 | A | * | 7/1989 | Wakai | 182/36 |
| 5,080,045 | A | * | 1/1992 | Reese et al. | 119/770 |
| 5,143,170 | A | | 9/1992 | Hunt et al. | |
| 5,156,233 | A | | 10/1992 | Olsen et al. | |
| 5,297,651 | A | * | 3/1994 | Vandelinde | 182/36 |
| 5,361,866 | A | | 11/1994 | Bell et al. | |
| 5,388,661 | A | | 2/1995 | Hood, Jr. | |
| 5,509,498 | A | * | 4/1996 | Higaki | 182/3 |
| 5,537,933 | A | * | 7/1996 | Ablad | |
| 5,581,955 | A | | 12/1996 | Gleave | |
| 5,694,720 | A | | 12/1997 | Walcher et al. | |
| 6,009,973 | A | * | 1/2000 | Woodyard | 182/36 |
| 6,148,580 | A | * | 11/2000 | Weir | 182/36 |
| 6,374,945 | B1 | * | 4/2002 | Sherwood | 182/3 |

FOREIGN PATENT DOCUMENTS

| | | | | |
|---|---|---|---|---|
| DK | 72350 | * | 4/1951 | 182/4 |

OTHER PUBLICATIONS

Guardian Fall Protection products catalog (date unknown).
Protection International products catalog, pp. 27, 29, 30, 31, 41 and 42 (1998).

* cited by examiner

*Primary Examiner*—Alvin Chin-Shue
(74) *Attorney, Agent, or Firm*—Klarquist Sparkman, LLP

(57) ABSTRACT

A personal fall protection system for securing a worker to an elevated and exposed structure defining a work area is disclosed. The fall protection system includes a safety belt supported on the worker's body with a body harness. The safety belt includes two belt couplings movable in a channel around the belt, each adapted to be attached to a lanyard. Two spaced apart rails are mounted adjacent opposite side limits of the structure. A movable anchor for securing the end of a lanyard is mounted to each rail. A lanyard ties off the worker at each belt coupling to an anchor. The fall protection system thereby secures the worker to both sides of the structure while allowing the worker to rotate relative to the lanyards within the work area and move freely forward and backwards throughout the work area between the rails.

15 Claims, 9 Drawing Sheets

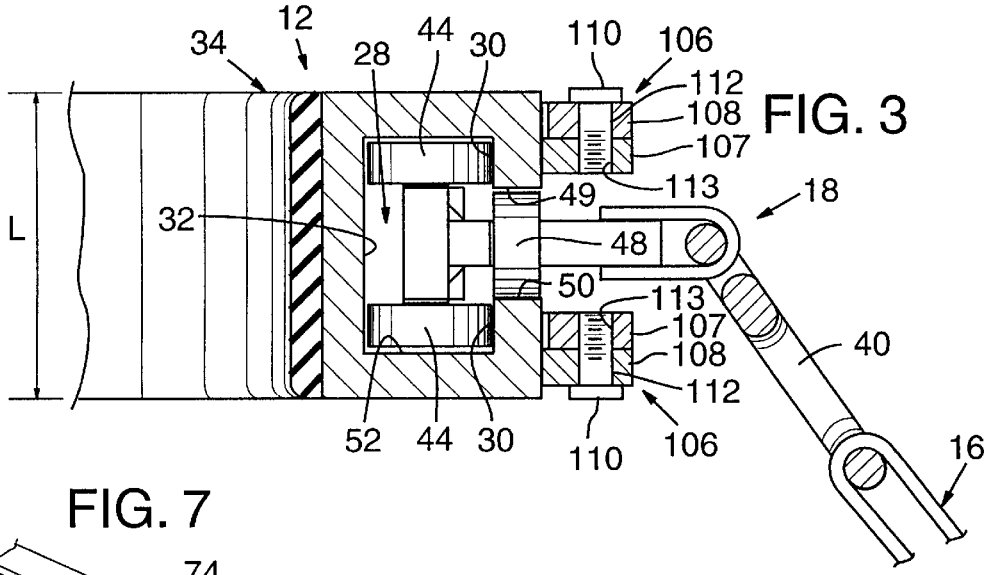
FIG. 3
FIG. 7
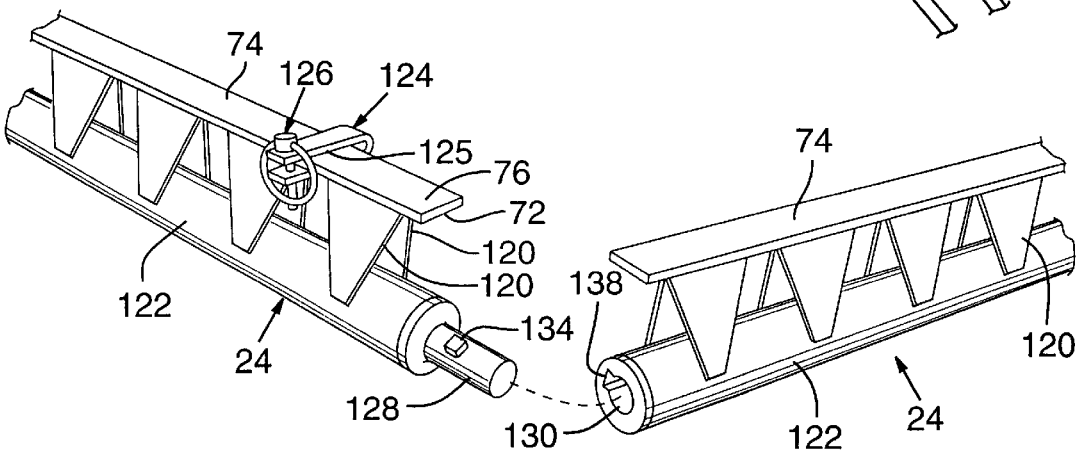
FIG. 8
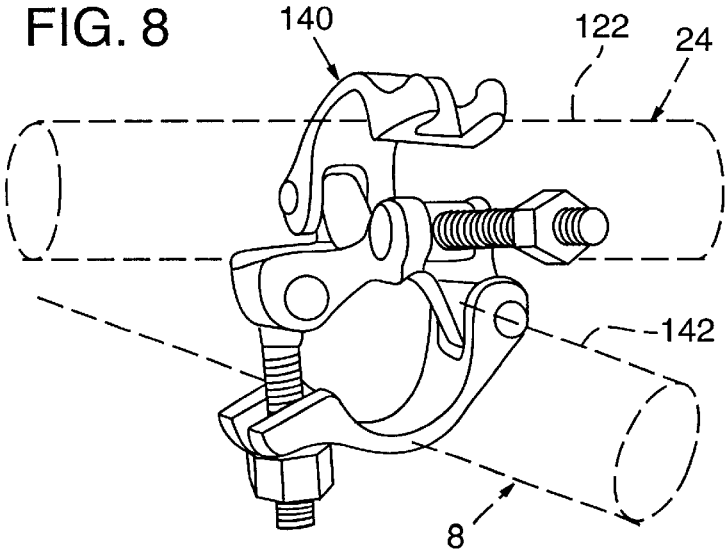

FALL PROTECTION METHOD AND APPARATUS

FIELD OF THE INVENTION

This invention relates generally to a personal fall protection system for ensuring the safety of a person requiring access to an exposed, elevated work area. More particularly, this invention relates to a personal fall protection method and system that provides continuous fall protection without restricting a worker's mobility.

BACKGROUND OF THE INVENTION

According to federal and state OSHA safety regulations, persons working in exposed, elevated work areas, such as on scaffolding structures, are required to be protected against falls over six feet. To comply with these safety regulations, personal fall arrest devices are commonly used to secure a worker to an elevated and exposed work area. One such device utilizes a body harness that is worn by the worker. A retaining ring, mounted to the dorsal portion of the body harness, is connected to one end of a lanyard. The other end of the lanyard is then tied off to a fixed anchor mounted on structure in the work area. By limiting the length of the lanyard to six feet or less, the worker is prevented from falling farther than is allowable under current OSHA regulations.

Nevertheless, conventional fall arrest devices do not always provide for adequate fall protection, especially during the erection of a scaffolding structure. Generally, a lanyard can be attached to an overhead anchor mounted to a wall or building adjacent the scaffolding. Because the range of motion for a worker is restricted by the lanyard, the lanyard must be disconnected from its anchor and then reconnected to another anchor to access a different portion of the work area. Thus, this type of fall protection is inadequate because the worker is left unprotected every time he or she is required to move beyond the range permitted by the lanyard.

To overcome this disadvantage, slidable anchors may be utilized as a means to provide a worker with a greater range of mobility. A commonly used slidable anchor comprises a generally C-shaped clamp that is adjustable to fit on the bottom or top flange of an I-beam. One end of a lanyard is connected to the clamp and the other end of the lanyard is connected to the dorsal portion of the body harness. The clamp is able to slide relative to the I-beam so that a worker can pull the lanyard and the clamp behind him as he moves fore and aft with respect to the beam. Alternatively, a safety cable system may be employed to permit access to a different portion of the work area without having to disconnect the lanyard. In such a system, a safety cable is supported by stanchion assemblies that are mounted on structure in a work area. A lanyard is slidably connected to the safety cable so that a worker can move freely with respect to the cable.

Although slidable anchors and safety cable systems provide for greater mobility, they nevertheless suffer from several disadvantages. For example, a conventional lanyard restricts the rotational movement of a worker because it is connected to a body harness at a fixed point. As a result, the lanyard will wrap around the worker's body when the body is turned or rotated, creating a tripping hazard.

In addition, if the scaffolding is not erected adjacent to another structure, then the lanyard can only be tied off to a point on the scaffolding itself. Because scaffolding is erected from the ground upward, the only available anchoring points for the lanyard are located in the plane of the walkway. This increases the danger of tripping over the lanyard and also increases fall distance.

Further, should a worker fall off the scaffolding, it is likely that the fall would be in an outward direction, causing the worker to swing into the scaffolding at the end of the fall, causing injury. In addition, the pull of the lanyard in a fall, directed at an angle with respect to the vertical plane defined by the upright portions of the often narrow scaffolding, may pull the scaffolding over and down, causing further injury.

Not surprisingly, workers frequently opt to forego the use of existing fall protection equipment because the foregoing dangers and encumbrances created by the lanyard outweigh its potential safety aspects. In some cases, OSHA recognizes an exception to the use of conventional fall protection equipment if the employer can demonstrate that such use creates a greater hazard to the worker. Accordingly, there is a need for a new and improved fall protection apparatus that overcomes the foregoing and other disadvantages of the prior art.

SUMMARY OF INVENTION

The present invention seeks to overcome the foregoing problems of the prior art by providing an improved personal fall protection method and system for securing a worker in an elevated, exposed work area. A primary objective of the present invention is to provide a personal fall protection system that provides continuous fall protection with minimal restriction or encumbrance of a worker's mobility.

The invention accomplishes this objective with a fall protection system that includes a safety belt having a track that encircles the waist of a worker. At least one belt coupling is movably mounted within the track for movement relative thereto. A rail, with an anchor movable along its length, is mounted to structure at the elevated work area. The anchor receives one end portion of a lanyard, the other end portion of which is connected to the belt coupling.

Thus, the worker is secured in the work area with a lanyard that is tied off at the belt coupling and the rail anchor. Nevertheless, the worker is able to rotate independently relative to the lanyard and belt coupling as the coupling travels in the belt track, and is also able to move freely forward and backward with respect to the rail as the anchor travels on the rail. Thus, the worker is never left unprotected from a fall because the lanyard remains connected to the same rail while accessing different portions of the work area. Moreover, the lanyard is prevented from wrapping around the worker's body because the belt coupling and the lanyard move independently of the belt as the worker turns or rotates.

One exemplary use for the fall protection system of the present invention is for providing continuous fall protection during the erection of a multi-level scaffolding structure. When the fall protection system is used during the erection of a scaffolding structure, a rail is mounted to each side of the scaffolding, usually in the plane defined by the walkway of the scaffolding. A safety belt, worn by a worker erecting the scaffolding, includes two belt couplings movable within the belt track, each connected to a different lanyard. Each lanyard extends from its belt coupling to a movable anchor on a respective rail such that the worker is tied off to both sides of the scaffolding structure. Since the effective length of each lanyard, measured from its belt coupling to a respective anchor, is shorter than the overall width of the scaffolding, the worker is prevented from falling over the open sides of the scaffolding. Because of the independent action of the belt couplings and anchors, the worker is able to rotate freely and move forward and backward within the work area between the rails without any restriction from the lanyards. In addition, the worker is protected from tripping over the lanyards because they do not require substantial slack and therefore do not drag on the walkway of the scaffolding. Further, the fall protection system provides continuous fall protection when the worker is required to access the next uppermost level of the scaffolding to be erected. This is accomplished by first mounting at least one rail to the next uppermost level. One of the anchors is then removed from its rail at the first level, leaving the worker properly secured to the scaffolding with a single lanyard. The lanyard connected to the unmounted anchor is lengthened so that its anchor can be mounted to the rail at the next level. After the previously unmounted anchor is secured to the rail at the next uppermost level, the anchor that is still mounted to a rail at the first level is removed from its rail. At this point, the worker may climb the outside of the scaffolding to access the next level while remaining properly secured to the scaffolding. This process is then repeated after the assembly of the scaffolding is completed at each level. Thus, the fall protection system provides continuous fall protection during the entire erection process of a multi-level scaffolding structure.

It is accordingly an object of this invention to provide a fall protection system and method that provides continuous fall protection to ensure the safety of a worker with minimal restriction of mobility throughout a relatively large work area.

Another object of the invention is to provide a fall protection system and method that enables unencumbered rotational and linear movement of a worker within a relatively large work area.

Yet another object of the invention is to provide an improved safety belt for a fall protection system that allows 360 degrees rotation of a worker relative to one or more lanyards affixed to the belt.

Still another object of the invention is to provide an improved lanyard for a fall protection system that provides an adjustable length for various applications.

Finally, it is an object of the invention to provide a rail and movable anchor system for movably attaching a lanyard and thus a safety belt and worker to an elevated and exposed structure.

The foregoing and other objects, features and advantages of the present invention, as well as additional embodiments thereof, are described further in the following detailed description, which proceeds with reference to the accompanying drawings.

BRIEF DESCRIPTION OF DRAWINGS

FIG. 3 is an enlarged cross-sectional view of a portion of the safety belt and a belt coupling of FIG. 2 taken along line 3—3.

FIG. 7 is a perspective view of two adjoining rails embodying the present invention.

FIG. 8 is a perspective view of a right angle clamp for coupling the shaft portion of a rail to a tubular member of a scaffolding structure.

DETAILED DESCRIPTION

Figure 1:
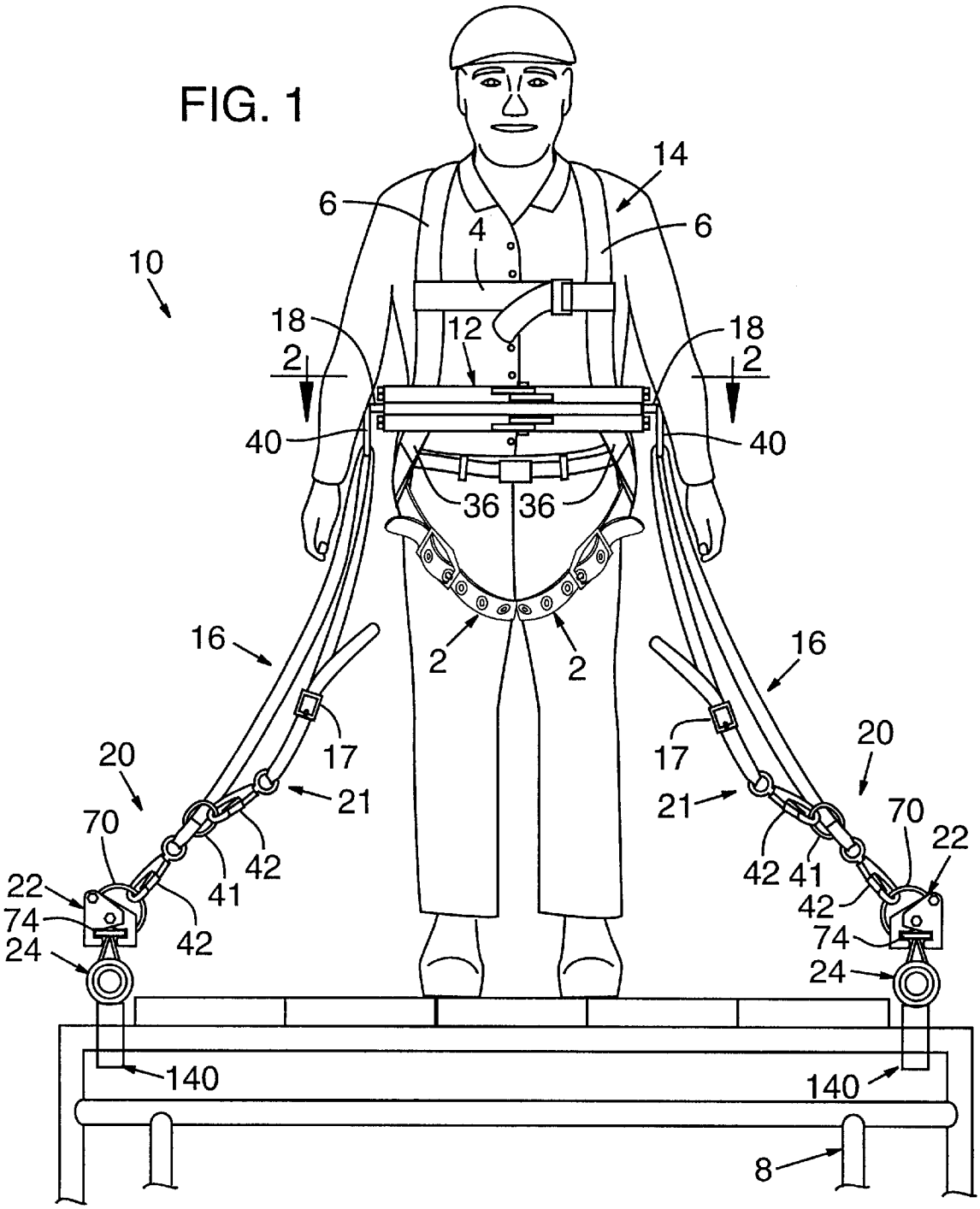
FIG. 1 is a depiction of a fall protection system embodying the present invention being used to secure a worker to a scaffolding structure.
Figure 2:
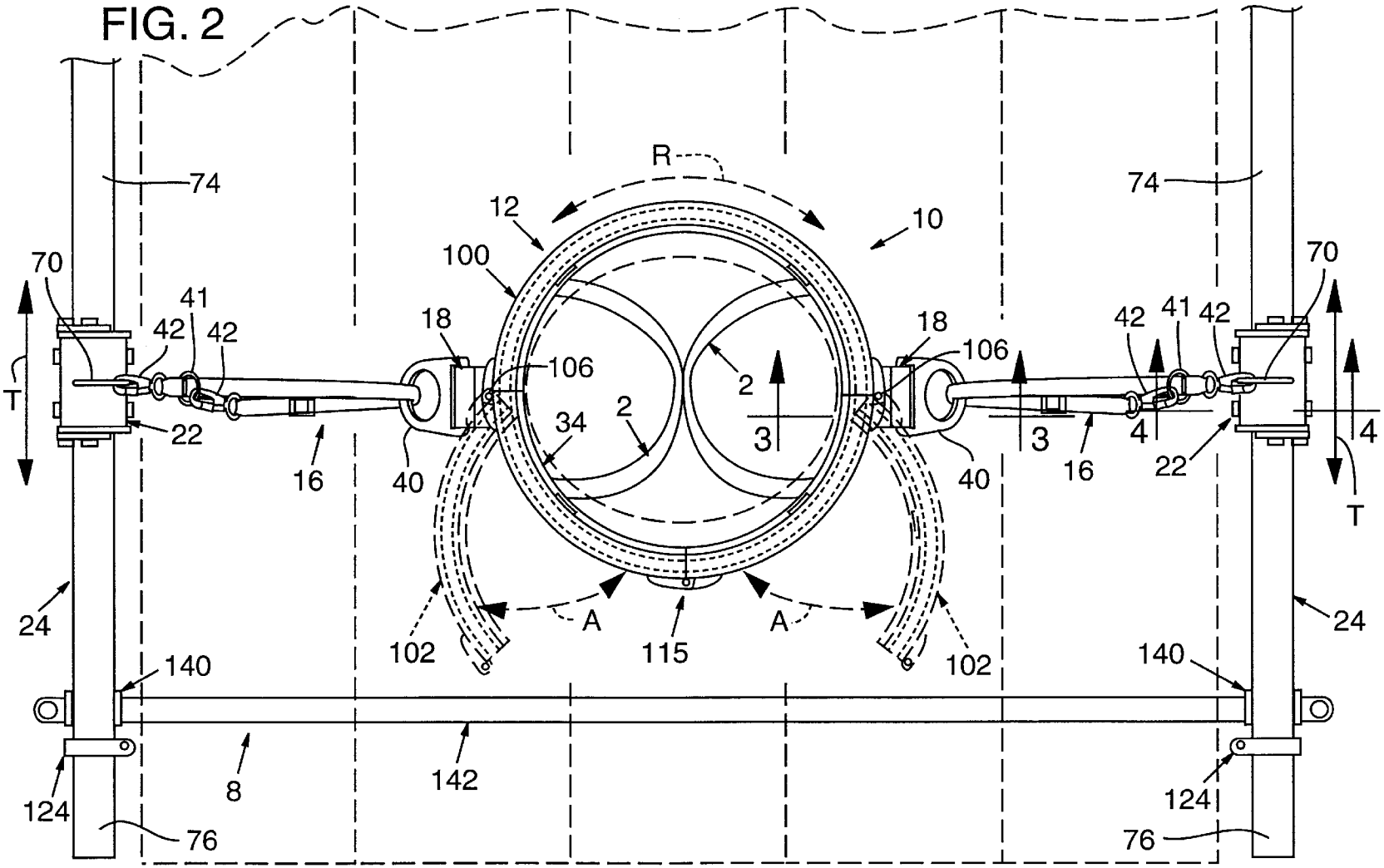
FIG. 2 is a top plan view of the fall protection system of FIG. 1.

According to a preferred embodiment of the present invention, as shown in FIGS. 1 and 2, a fall protection system 10 is shown being used to secure a worker to a scaffolding structure 8. The fall protection system 10 comprises five main components: a safety belt 12, a body harness 14, a pair of lanyards 16, a pair of movable anchors 22, and a pair of rails 24. The safety belt 12, which is supported on the worker's body with the body harness 14, includes a pair of movable belt couplings 18 positioned at diametrically opposite sides of the safety belt 12. Each belt coupling 18 includes a retaining ring 40 that has an opening for receiving a lanyard 16. Each retaining ring 40 preferably comprises a conventional D-ring, formed of any suitable material.

The rails 24 are mounted adjacent the open sides of the scaffolding structure 8. Each anchor 22 is movably coupled to a respective rail 24. Each lanyard 16 ties off the worker at a belt coupling 18 to a respective anchor 22 in the following manner. Each lanyard 16 has a first and second end, 20 and 21, each of which terminates in a releasable connector 42, which preferably comprises a conventional snaphook. The connector 42 on the first end 20 of each lanyard is coupled to a first mounting ring 70 that is welded to a respective anchor 22. Each lanyard 16 slidably extends through the opening in a retaining ring 40 of a belt coupling, and back towards its first end 20, thereby forming a loop. The connector 42 on the second end 21 of each lanyard is coupled to a second mounting ring 41 that is secured to its first end 20. Each lanyard 16 includes means for adjusting its length to accommodate the height of the worker's waist. Such an adjustment means in the illustrated embodiment comprises the adjustment buckle 17. Further, the effective length of a lanyard can be increased to approximately twice its original length by removing the connector 42 of the second end 21 from the mounting ring 41 and attaching it directly to the retaining ring 40 of the belt coupling. This feature is significant as will be explained below in the description of the use of the fall protection system 10. Further details of the safety belt, body harness, lanyards, anchors, and rails are provided as follows.

Figure 1A:
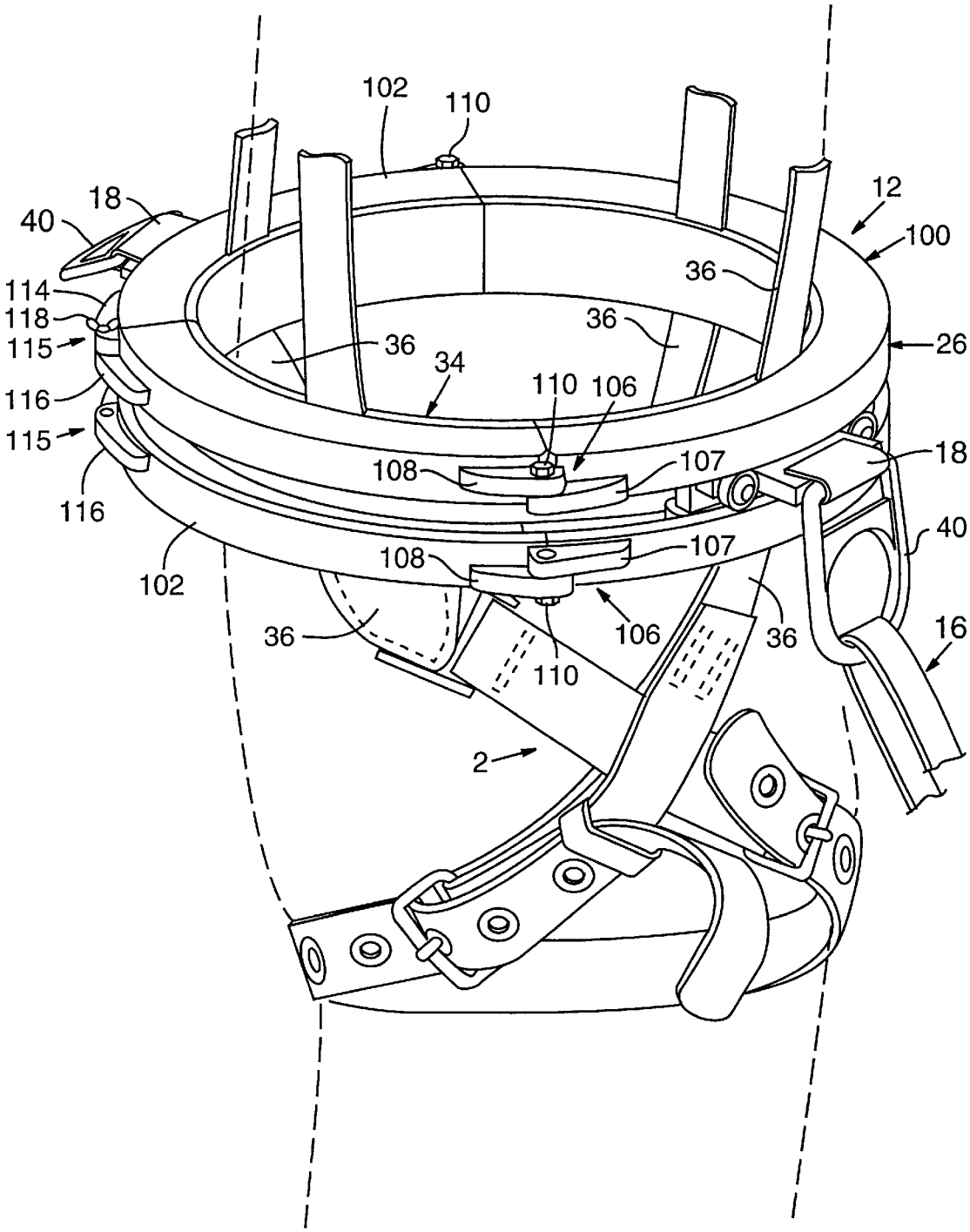
FIG. 1A is perspective view of a safety belt and thigh straps embodying the present invention.

As can be seen in FIG. 1A, the safety belt 12 includes an outer track 26 adapted to encircle the waist of the worker. Preferably, the safety belt 12 is generally elliptical in shape to conform to the cross-sectional shape of the worker's waist. An elastomeric inner liner 34 is bonded to the inside surface of the outer track 26. Tip Top SC2000, manufactured by Mill Supply Corp., is a suitable adhesive for bonding the inner liner 34 to the outer track 26. The inner liner cushions the fall arrest forces transferred by the safety belt to the waist of the worker should there be a fall.

Figure 1B:
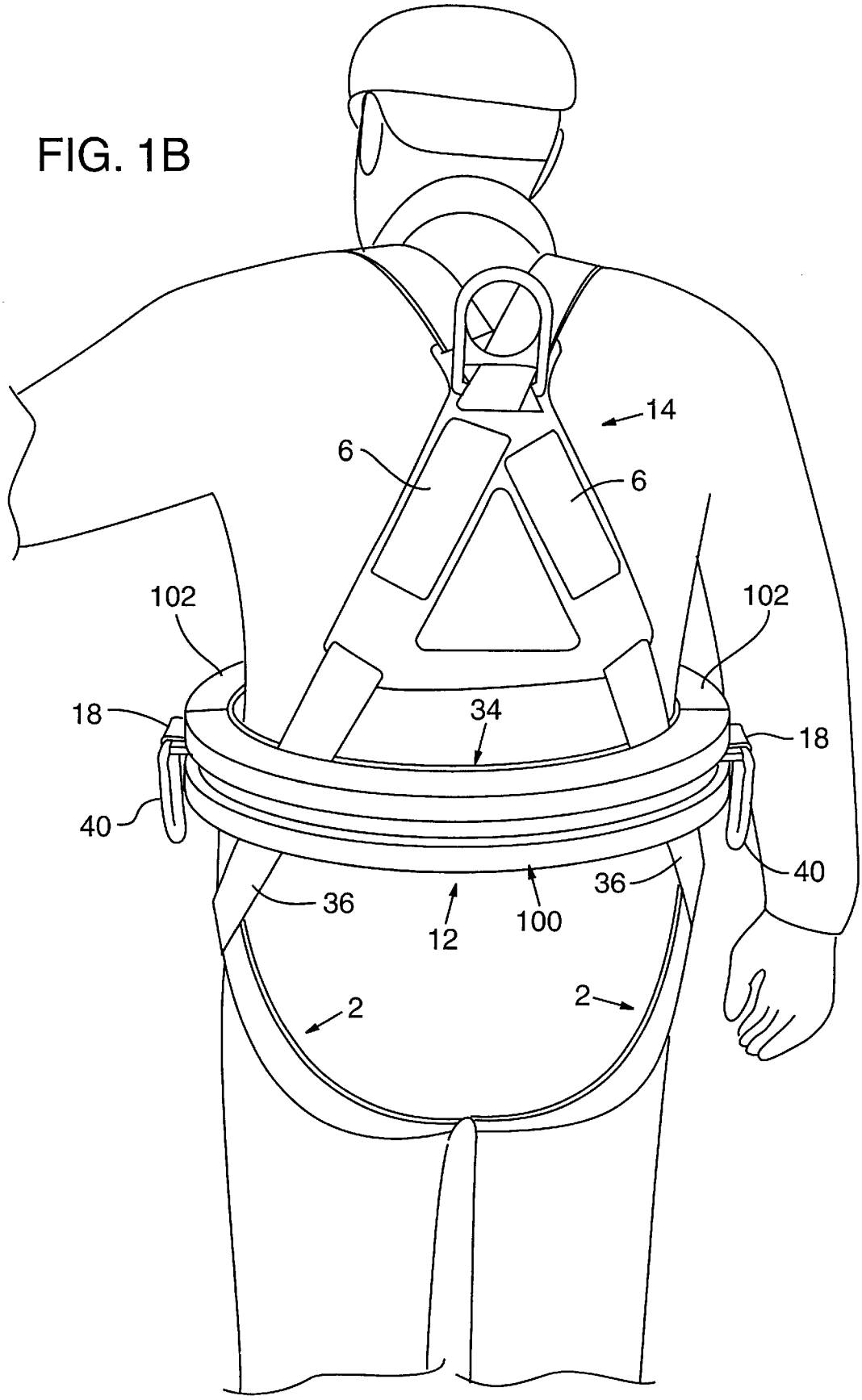
FIG. 1B is a back view of a worker wearing a safety belt and body harness embodying the present invention.

The body harness 14, which is attached to the safety belt 12, comprises a pair of crossed shoulder straps 6 (see FIG. 1B), a chest strap 4 secured at each end to a shoulder strap (see FIG. 1), and a pair of thigh straps 2. The body harness supports the safety belt 12 on the worker and distributes the fall arrest forces over at least the shoulders, chest, waist, and thighs of the worker in the event of a fall. Any commercially available body harness that meets the fall arrest requirements as set forth by OSHA is suitable for use in the present invention. One such body harness is manufactured by Guardian Fall Protection of Auburn, WA. The body harness 14 is attached to the safety belt 12 in the following manner. The bottom end portions 36 of the shoulder straps 6 extend through the belt between the inner liner 34 and the outer track 26. The adhesive used to bond the inner liner to the outer track secures portions 36 of the shoulder straps to the safety belt. Alternatively, the bottom end portions 36 of the shoulder straps may be attached to the safety belt with mechanical fasteners, such as bolts or rivets.

Referring to FIGS. 1A and 2, the outer track 26 comprises an arcuate back portion, or section, 100 and two arcuate access sections, portions, or doors 102. The back portion 100, which is placed adjacent the lower back of the worker, terminates in two spaced apart ends. Each access door 102 is pivotally connected to one end of the back portion 100 with a pair of hinges 106. Each hinge 106 comprises a first ear 107 projecting outwardly from one end of the back portion 100 and a corresponding second ear 108 projecting outwardly from an adjacent end of an access door 102. A threaded bolt 110 extends through a non-threaded aperture 112 defined in the second ear 108 and is screwed into a threaded aperture 113 in the first ear 107 of each hinge 106 (see FIG. 3).

The access doors 102 are swingable between open and closed positions to permit the worker to enter or exit the belt (indicated by arrows A in FIG. 2). A pair of latches 115 are disposed on the front portion of the outer track to ensure that the access doors 102 remain closed while the safety belt is being used. Referring to FIG. 1A, each latch comprises a first ear 114 projecting outwardly from the front end of an access door 102 and a corresponding second ear 116 projecting outwardly from the front end of the other access door 102. A wing bolt 118 extends through a non-threaded aperture defined in the first ear 114 and is screwed into a threaded aperture in the second ear 116 of each latch 115. The wing bolts 118 are manually operable to permit access to and from the safety belt without the assistance of a tool.

Referring to FIG. 3, there is shown a circumferential C-shaped channel 28 defined in the outer track and extending fully thereabout when the belt is closed. The channel 28 includes front and rear surfaces 30 and 32, which face inwardly of the channel. Longitudinally extending upper and lower lips, or surfaces, 49 and 50 define a circumferential opening therebetween. The belt couplings 18, disposed in the channel 28, are operable to rotate completely around the safety belt 12 so that the worker is able to freely rotate 360 degrees when the lanyards 16 are secured to their respective anchors (indicated by arrow R in FIG. 2).

Figure 6:
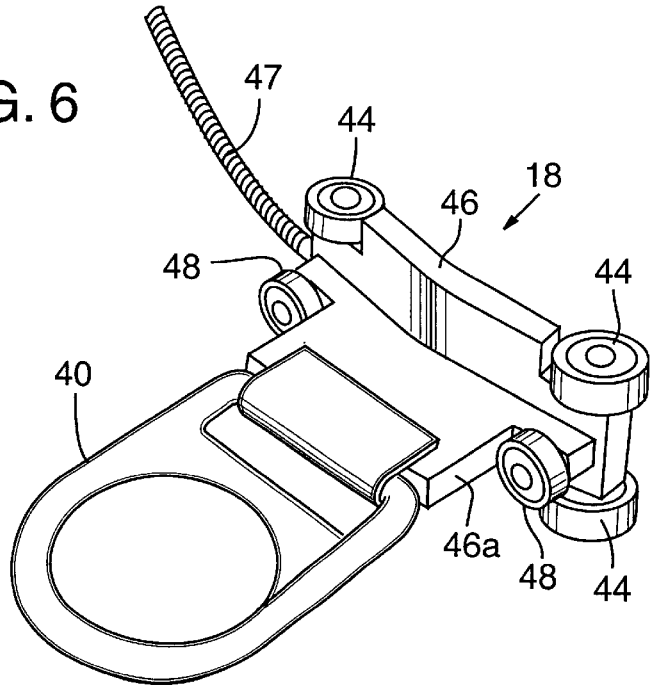
FIG. 6 is a perspective view of a belt coupling embodying the present invention.

Referring to FIG. 6, there is shown a detailed illustration of a belt coupling 18 used in the present invention. As should be appreciated from the drawings, the configuration of both belt couplings are identical. Accordingly, the following description will proceed with reference to the configuration of the belt coupling depicted in FIG. 6. As shown in FIG. 6, the belt coupling 18 has an arcuate shaped main body 46 to conform generally to the curvature of the channel 28 and a perpendicularly disposed extension portion 46*a*. To facilitate movement of the belt coupling within the channel, a horizontal wheel 44 is disposed on each corner of the body 46 for engaging the front and rear surfaces 30 and 32 of channel 28. Two spaced apart vertical wheels 48 are disposed on extension portion 46*a* for engaging the upper and lower lips 49 and 50 of channel 28. When the belt coupling is disposed in the channel, as shown in FIG. 3, the horizontal wheels 44 are loosely nested between the front and rear surfaces 30 and 32, and the vertical wheels 48 are loosely nested between the upper and lower lips 49 and 50. The vertical wheels 48 ensure that the belt coupling remains vertically centered within the channel so that the lower two horizontal wheels 44 do not contact the bottom surface 52 of the channel.

An elongated, flexible spacer 47 having two spaced apart ends, each of which is attached to a belt coupling 18, maintains a predetermined minimum spacing between the belt couplings. Preferably, the length of the spacer 47 is approximately one half the circumference of the channel so that the belt couplings and thereby the lanyards remain on generally diametrically opposite sides of the safety belt at all times. The spacer 47 preferably comprises a stiff coil spring.

When there is a fall, the lanyards transfer a significant amount of force to the belt couplings, which in turn is transferred to the inside surfaces of the channel defined in the outer track. To prevent lateral deformation of the outer track 26 from the fall arrest forces, the outer track 26 is comprised of a strong material, such as steel, aluminum or plastic, that is rigid in at least the lateral direction (indicated by arrow L in FIG. 3). By preventing lateral deformation of the outer track, the belt couplings 18 will remain within the channel when there is a fall.

Turning now to FIGS. 4, 5, 7, and 8, the details of the anchors 22 and rails 24 will be considered. As disclosed in FIG. 7, each rail 24 comprises an elongated shaft 122 that extends along the length of the scaffolding structure. An elongated rectangular plate 74 for carrying an anchor is spaced from the shaft 122 (see also FIG. 4). Two rows of structural webbing 120 are secured, as by welding, to the shaft 122 and plate 74, thus coupling shaft 122 to plate 74. The length of each rail is approximately 10 feet, which corresponds to the length of a standard scaffolding structure. When a longer rail is needed, such as when two scaffolding structures are erected end-to-end, two rails can be coupled lengthwise by inserting the male end 128 of one rail into the female end 130 of a another rail. Accordingly, additional rails may be similarly coupled along the entire length of a system of scaffolding structures placed end-to-end. A key 134 mounted to the male end 128 of each shaft, is received by a keyway 138 in the female end 130 of a successive rail to prevent relative twisting movement between two successive rails. When two or more rails are so coupled, the plates 74 of each rail mate at each end to effectively form a single continuous rail on which an anchor can travel. The shaft 122 of each rail 24 is mounted with a right angle clamp 140 to a tubular member 142 of the scaffolding structure that extends perpendicularly between the two rails (see FIGS. 2 & 8).

Figure 4:
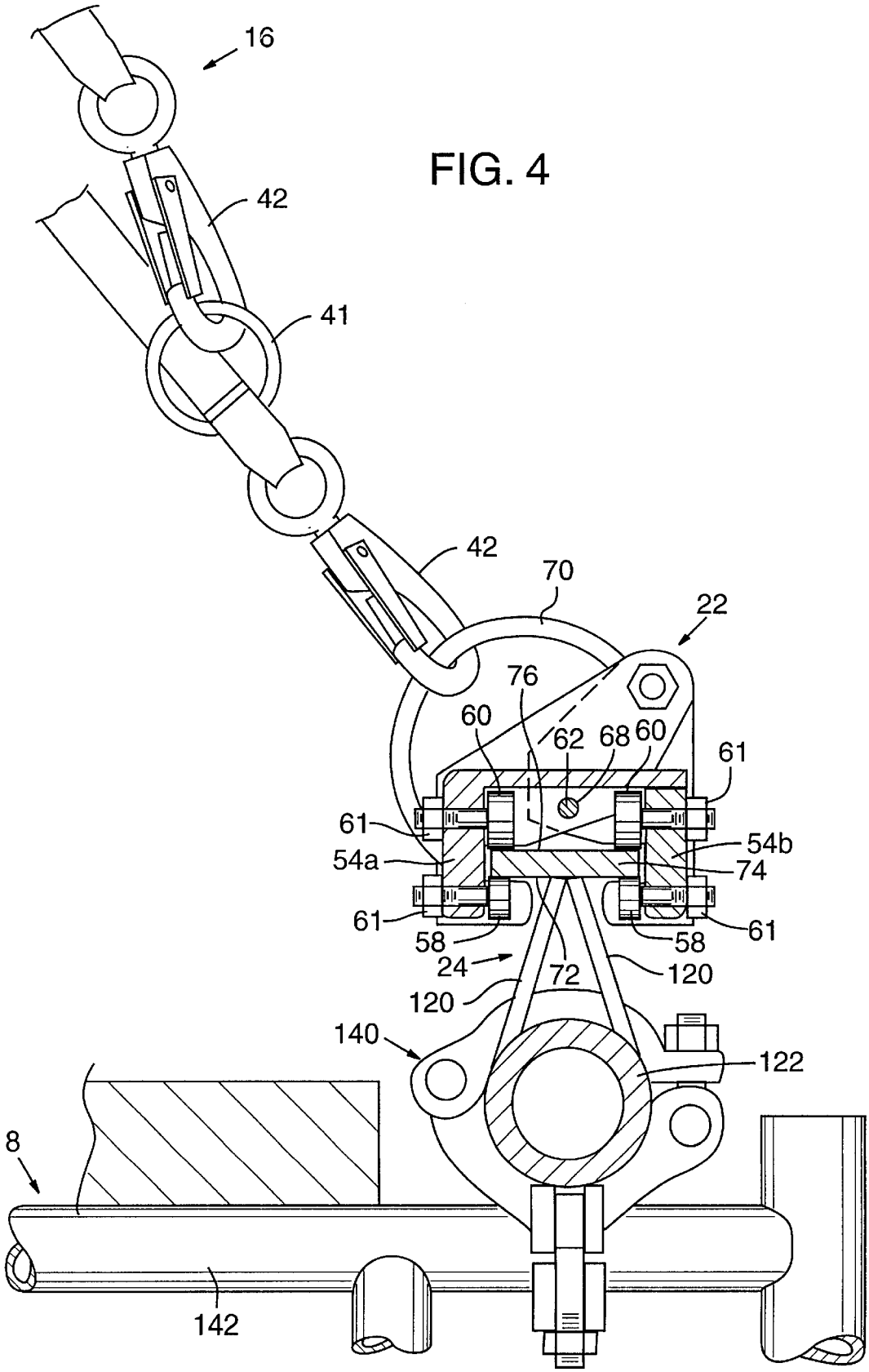
FIG. 4 is an enlarged cross-sectional view of a rail and anchor of FIG. 2 taken along line 4—4.
Figure 5:
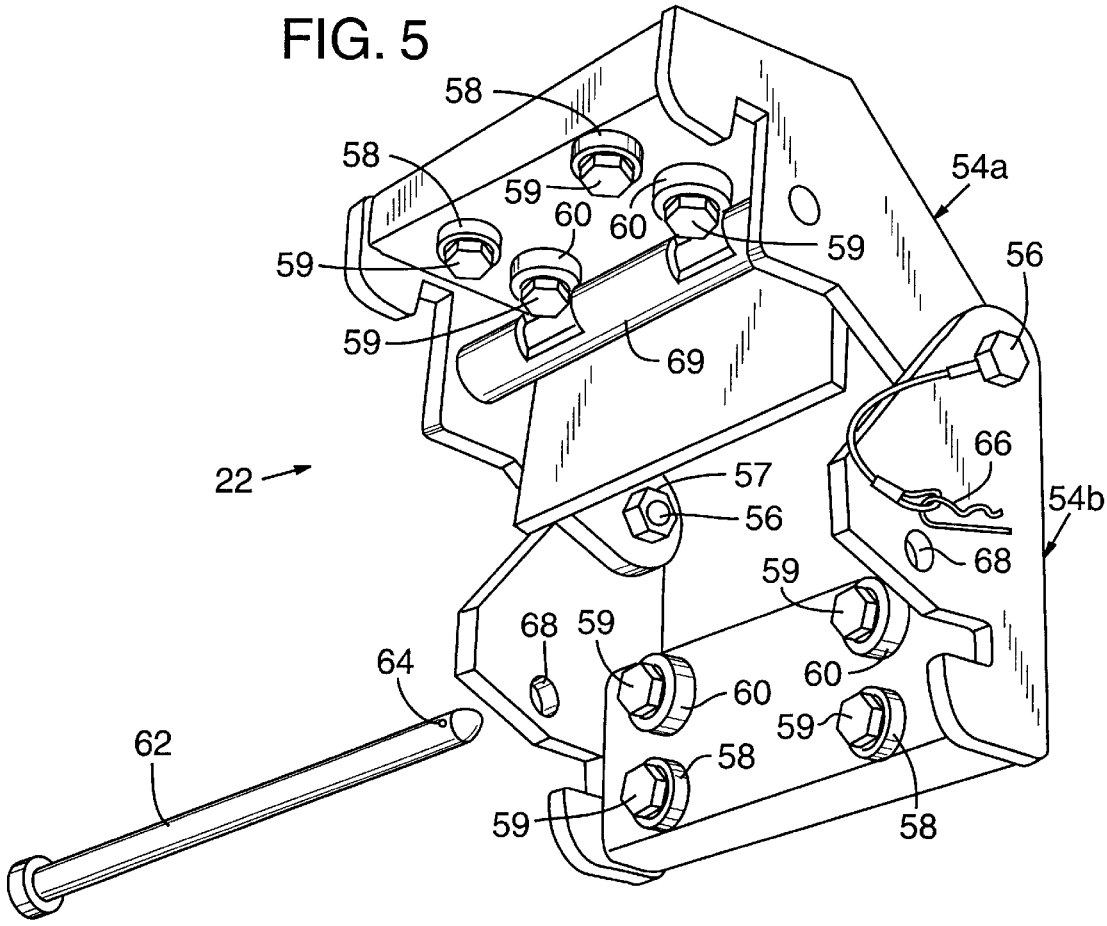
FIG. 5 is a perspective view of an anchor embodying the present invention.

Referring to FIGS. 4 and 5, there is shown a detailed illustration of an anchor 22 used in the present invention. As should be appreciated from the drawings, the configuration of both anchors 22 are identical. Accordingly, the following description will proceed with reference to the configuration of the anchor depicted in FIGS. 4 and 5. As can be seen in FIG. 5, the anchor 22 includes two rail engaging portions 54*a*, 54*b* pivotally connected to each other by bolts 56. A nut 57 is disposed on the inner end of each bolt 56 within the interior of the anchor 22. Due to the pivotal connection between the two rail engaging portions, the anchor 22 is releasably clampable at any point along the length of a rail 24. When the rail engaging portions 54*a*, 54*b* are opened (as shown in FIG. 5), the anchor may be placed on or removed from plate 74 of a rail 24. When the rail engaging portions 54*a*, 54*b* are closed around plate 74 of a rail 24 (as shown in FIG. 4), the anchor 22 is operable to move forward and backward longitudinally with respect to the rail (indicated by arrows T in FIG. 2).

To facilitate movement of the anchor on the plate, a plurality of lower and upper roller bearings, 58 and 60, for engaging the bottom and top surfaces 72 and 76 of a plate 74, are mounted to the inside surface of each rail engaging portion 54*a*, 54*b* by bolts 59. The bolts 59 extend through the sides of the rail engaging portions 54*a*, 54*b* and are secured with nuts 61 disposed on their outer ends outside the anchor 22. The opposed spaced end walls of the rail engaging portions 54*a*, 54*b* define openings 68 that align when the rail engaging portions 54*a*, 54*b* are in the closed position (as shown in FIG. 4). When the openings 68 are aligned, a removable locking pin 62 extends through openings 68 and an alignment sleeve 69 to ensure that the anchor remains clamped to the plate. A hole 64 is defined in the outer end of the locking pin 62 that extends through the front end wall of the anchor when the locking pin is fully inserted into openings 68. A removable cotter pin 66 is insertable through hole 64 to prevent the locking pin 62 from backing out of openings 68.

A removable stop 124 is positioned at each end of the plate 74 to prevent the anchor 22 from sliding off the end of a rail (see FIG. 2). Referring to FIG. 7, the stop 124 may be a U-shaped clip which has two parallel legs 125 configured to extend laterally of and engage the bottom and top surfaces 72 and 76 of a plate between two adjacent segments of structural webbing 120. A removable locking pin 126 extends through aligned apertures defined in the outer ends of the legs 125 to secure the stop on the plate.

As previously mentioned, the belt couplings are able to rotate in the channel completely around the safety belt and the anchors are able to move forward and backward with respect to the rails. When a worker is secured to both sides of the scaffolding structure 8 with the fall protection system 10, as shown in FIGS. 1 and 2, the worker is able to rotate 360 degrees relative to the lanyards and move laterally and longitudinally with respect to the rails. Thus, the fall protection system allows the worker to assemble the scaffolding structure with minimal restriction of mobility. Because the lanyards remain secured to the anchors at all times during the erection of a level of scaffolding, the fall protection system provides for continuous fall protection. Since the effective length of each lanyard, measured from its belt coupling to a respective anchor, is shorter than the overall width of the scaffolding, the worker is prevented from falling over the open sides of the scaffolding. Moreover, the danger of tripping over the lanyards is eliminated because they do not require substantial slack and therefore do not drag on the walkway of the scaffolding.

Figure 9:
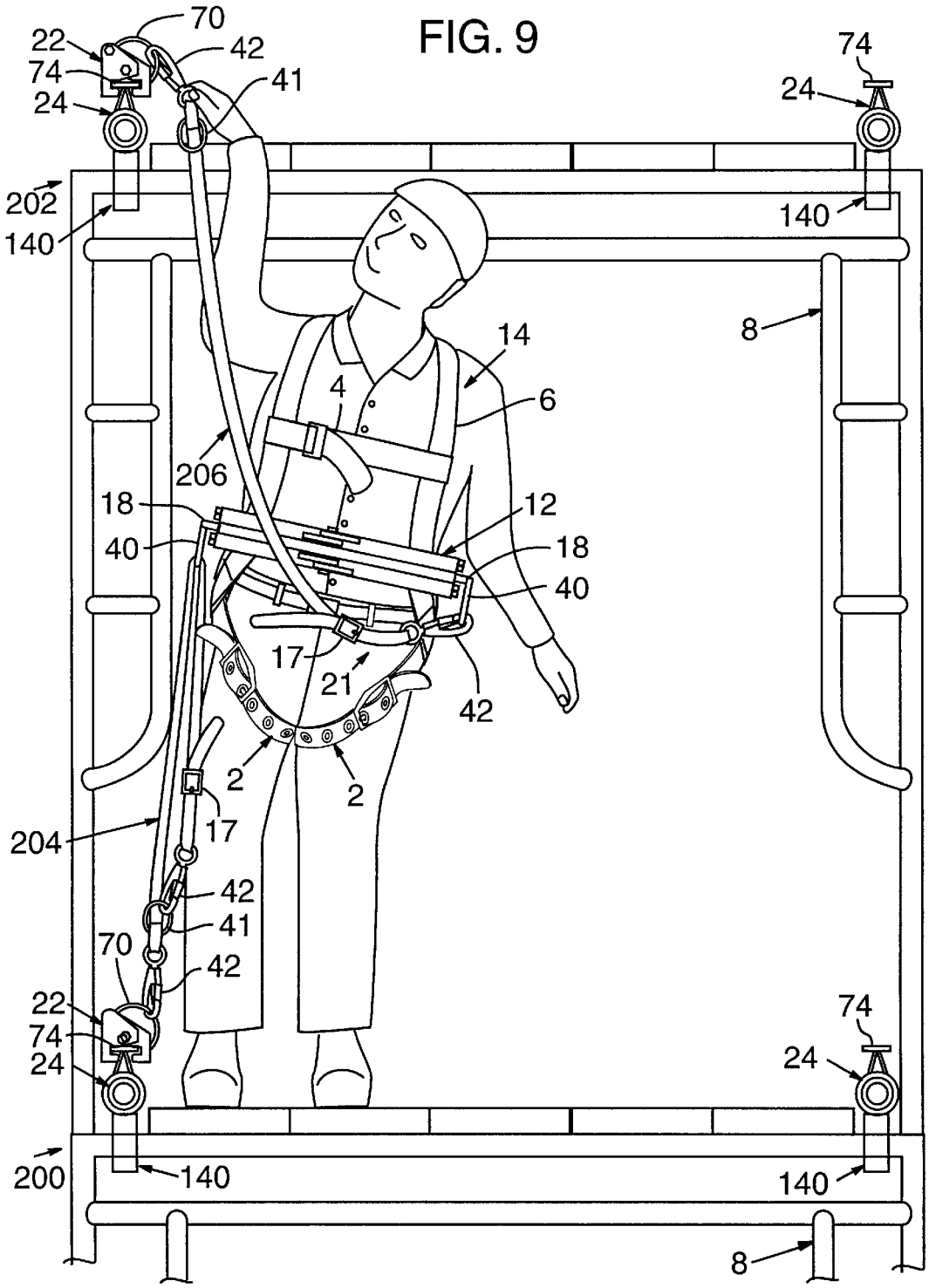
FIG. 9 illustrates a method of using the fall protection system of FIG. 1 to access the next uppermost level of a scaffolding structure.

Further, as shown in FIG. 9, the fall protection system provides continuous fall protection when the worker is required to ascend the scaffolding structure from a first level 200 to a second higher level 202. This may be accomplished in the following manner. First, at least one rail 24 is mounted to the second level 202. One of the anchors is then removed from its rail 24 at the first level 200, leaving one secured lanyard 204 and one unsecured lanyard 206. The connector 42 on the second end 21 of the unsecured lanyard 206 is removed from its mounting ring 41 and coupled to the mounting ring 40 on the belt coupling, thereby increasing the effective length of the unsecured lanyard to approximately twice its original length (i.e., from 3 feet to 6 feet) so that it may reach the second level 202. The anchor connected to the unsecured lanyard 206 is then coupled to the rail at the second level so that the worker is tied off at both levels, as depicted in FIG. 9. The anchor that is still coupled to a rail at the first level is then removed from its rail, leaving the worker secured only at the second level. At this point, the worker may climb the outside of the scaffolding to access the second level while remaining properly secured to the scaffolding. This process is then repeated after the assembly of the scaffolding is completed at each level. Thus, the fall protection system provides continuous fall protection during the entire erection process of a multi-level scaffolding structure.

Figure 10:
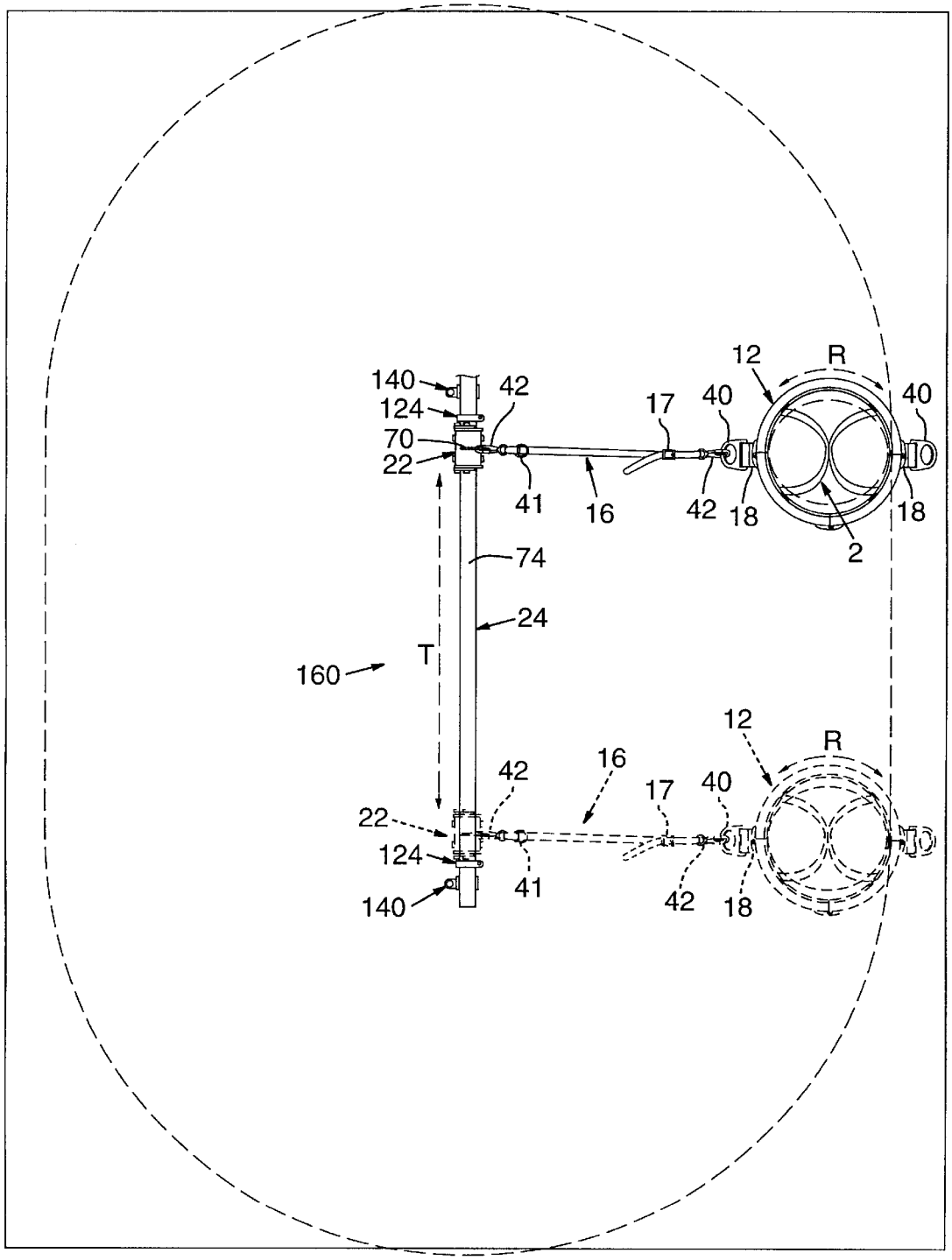
FIG. 10 is a depiction of a fall protection system embodying the present invention being used on a roof with unprotected sides.

Another embodiment of the invention is shown in FIG. 10. In this embodiment, a fall protection system 160 employing a single lanyard 162 is shown for securing a worker (not shown for clarity) to a roof of a building with unprotected sides. The fall protection system 160 includes a safety belt 12 and a pair of belt couplings 18, as previously described, with a pair of retaining rings 40. The lanyard 16 is coupled at one end to a retaining ring 40 on the belt coupling 18 with a releasable connector 42. The other end of the lanyard 16 is coupled to a mounting ring 70 on an anchor 22 with a second releasable connector 42. Preferably, each releasable connector 42 comprises a conventional snaphook. A rail 24 is mounted in the center of the roof. The anchor 22 is movably coupled to the rail 24 such that it is operable to move relative thereto (as indicated by arrow T). A second safety belt, lanyard, and anchor assembly is shown in phantom to illustrate the range of motion for the anchor along the rail. Removable stops 124 are mounted at each end of the rail 24 to prevent the anchor from sliding off the rail.

The length of the lanyard 16 is adjusted with adjustment buckle 17 to prevent the worker from falling off the roof while allowing access to the unprotected sides. When a worker is secured to the roof with the fall protection system 160, as shown in FIG. 10, the worker is able to rotate 360 degrees relative to the lanyard and move laterally and longitudinally with respect to the rail. Thus, the fall protection system 160 provides for continuous fall protection while allowing access to substantially the entire work area defined by the roof.

The present invention has been shown in the described embodiments for illustrative purposes only. The present invention may be subject to many modifications and changes without departing from the spirit or essential characteristics thereof. We therefore claim as our invention all such modifications as come within the spirit and scope of the following claims.

I claim:

1. Fall protection apparatus for securing a worker to an elevated and exposed structure defining a work area comprising:

a safety belt having a circumferential track defining a radially outwardly opening channel, the belt being adapted to encircle the waist of the worker, first and second belt couplings received in the channel at opposite sides of the belt and operable to move along the track through 360°;

a spacer member received in said channel, said first and second belt couplings attached to respective ends of the spacer member to maintain the belt couplings on said opposite sides of the belt;

first and second elongated rails for mounting to the structure;

first and second anchors, the first anchor for coupling to the first rail and movable longitudinally thereof when so coupled, the second anchor for coupling to the second rail and movable longitudinally thereof when so coupled; and first and second lanyards, the first lanyard for coupling to the first anchor and the first belt coupling, the second lanyard for coupling to the second anchor and the second belt coupling, whereby whenever the first and second rails are mounted to the structure and the worker is coupled to the first and second rails through the first and second lanyards, the worker is able to rotate independently relative to the firs and second lanyards and move longitudinally with respect to the first and second rails within the work area.

2. The apparatus of claim 1, wherein the spacer member is configured to maintain the first and second belt couplings on generally diametrically opposite sides of the track.

3. The apparatus of claim 1, wherein the safety belt comprises a first elongated arcuate section and at least a second elongated arcuate section hingedly connected at one of its ends to an end of the first arcuate section for pivoting relative to each other between a closed position in which they form the circumferential track to encircle the waist of the worker and an open position allowing the belt to be placed about the waist of the worker.

4. The apparatus of claim 3, wherein the safety belt further comprises a third elongated arcuate section hingedly connected at one of its ends to the end of the first arcuate section opposite the end to which the second arcuate section is connected, the second and third arcuate sections being swingable between an open position for permitting the worker to access the belt and a closed position operating in conjunction with the first arcuate section to form said track.

5. The apparatus of claim 1, wherein the track is generally elliptical in shape to conform to the cross sectional shape of the worker's waist.

6. The apparatus of claim 1, wherein the safety belt further comprises an elastomeric inner liner attached to the track to cushion the fall arrest forces on the waist of the worker.

7. The apparatus of claim 1 wherein the first and second rails are mounted substantially parallel to each other.

8. The apparatus of claim 1 which further comprises a body harness secured to the track.

9. The apparatus of claim 1 wherein each anchor comprises two rail engaging portions pivotally connected to each other such that the anchor may be placed on a respective rail by being swung towards each other and removed from the tail when the rail engaging portions are swung away from each other.

10. The apparatus of claim 1 wherein each rail comprises an elongated plate for carrying a respective anchor, an elongated shaft spaced laterally from and parallel to the plate and adapted to be completely detachable to the structure, and a row of structural webbing coupling the plate to the shaft.

11. The apparatus of claim 1 wherein the channel has a substantially C-shaped cross-section, a first portion of each belt coupling is captured therein and an extension portion of each belt coupling projects outwardly through the open side of the C-shaped cross-section of the channel.

12. The apparatus of claim 11 which further comprises elongated third and fourth rails, the third rail adapted to be coupled to one end of the first rail and the fourth rail adapted to be coupled to one end of the second rail such that the first anchor can move unencumbered relative to the first and third rails and the second anchor can move unencumbered relative to the second and fourth rails when the rails are mounted to the structure.

13. The apparatus of claim 12 wherein each rail comprises an elongated plate for cog the anchor, an elongated shaft spaced laterally from and parallel to the plate and adapted to be detachable from the structure, and a row of structural webbing coupling the plate to the shaft, the shaft of the first rail having a male end connector and the shaft of the third rail having a female end connector for coupling the first and third rails end-to-end, the shaft of the second rail having a male end connector and the shaft of the fourth rail having a female end connector for coupling the second and fourth rails end-to-end.

14. The apparatus of claim 13 which further comprises:

a key formed on one of said end connectors of the first and third rails, a receiving keyway formed on the other of said end connectors of the first and third rails configured to closely receive said key when said first and third rails are coupled end-to-end to maintain the first and third rails in selected longitudinal alignment and;

a key formed on one of said end connectors of the second and fourth rails, a receiving keyway formed on the other of said end connectors of the second and fourth rails configured to closely receive said key when said second and fourth rails are coupled end-to-end to maintain the second and fourth rails in selected longitudinal alignment.

15. A fall protection apparatus for securing a worker to an elevated and exposed structure defining a work area comprising:

a safety belt having a circumferential track defining a radially outwardly opening channel and an elastomeric inner liner attached to the track, the track being rigid in at least the lateral direction and adapted to encircle the waist of the worker, the track comprising an arcuate door supporting portion terminating in two spaced apart ends, and two arcuate access door portions including one pivotally connected to one end of the door supporting portion and the other pivotally connected to the opposite end of the door supporting portion, the access door portions being swingable between open and closed positions for permitting the worker to access the belt;

a body harness attached to the safety belt;

a pair of belt couplings received in the channel at diametrically opposite sides of the belt and operable to move relative to the channel;

a spacer disposed in the channel and terminating in two spaced apart ends, each of which is attached to one of said belt couplings, the spacer being generally semicircular maintain the belt couplings on generally diametrically opposite sides of the track;

a pair of spaced apart elongated rails mounted to opposite sides of the structure, each rail comprising an elongated plate, an elongated shaft spaced laterally from and parallel to the plate, and a row of structural webbing coupling the plate to the shaft;

a pair of anchors, each of which is coupled to one of said elongated plates and movable relative thereto, each anchor comprising two rail engaging portions pivotally connected to each other such that the anchor may be placed on its rail by being swung towards each other and removed from the rail when the rail engaging portions are swung away from each other; and a pair of lanyards disposed at opposite sides of the worker, each lanyard extending from one of said anchors to a corresponding belt coupling, thereby securing the worker to both sides of the structure between the rails and enabling the worker to rotate independently relative to the lanyards and move laterally and longitudinally relative to the rails within the work area.

* * * * *